US009540215B2

(12) United States Patent
Hawkins et al.

(10) Patent No.: US 9,540,215 B2
(45) Date of Patent: Jan. 10, 2017

(54) METHOD FOR INSTALLING AN ELEVATOR CAR SLING

(71) Applicants: Giovanni Hawkins, Helsinki (FI); Mikko Vesterinen, Helsinki (FI)

(72) Inventors: Giovanni Hawkins, Helsinki (FI); Mikko Vesterinen, Helsinki (FI)

(73) Assignee: Kone Corporation, Helsinki (FI)

( * ) Notice: Subject to any disclaimer, the term of this patent is extended or adjusted under 35 U.S.C. 154(b) by 224 days.

(21) Appl. No.: 14/448,166

(22) Filed: Jul. 31, 2014

(65) Prior Publication Data

US 2015/0075113 A1 Mar. 19, 2015

(30) Foreign Application Priority Data

Sep. 16, 2013 (EP) ..... 13184472

(51) Int. Cl.

| | |
|---|---|
| ***B66B 19/00*** | (2006.01) |
| ***B66B 7/04*** | (2006.01) |
| ***B66B 19/04*** | (2006.01) |
| ***B66B 11/02*** | (2006.01) |

(52) U.S. Cl.

CPC ..... *B66B 19/00* (2013.01); *B66B 7/047* (2013.01); *B66B 7/048* (2013.01); *B66B 11/0206* (2013.01); *B66B 19/04* (2013.01); *Y10T 29/53983* (2015.01)

(58) Field of Classification Search

CPC ..... B66B 19/00; B66B 19/04; B66B 7/048; B66B 7/047; B66B 11/0206; Y10T 29/53983

USPC ..... 187/414, 409

See application file for complete search history.

(56) References Cited

U.S. PATENT DOCUMENTS

| | | | | |
|---|---|---|---|---|
| 2,045,620 | A * | 6/1936 | Spullies | B66B 7/047 187/409 |
| 2,490,652 | A * | 12/1949 | Sahlin | B66B 7/047 187/409 |
| 4,271,932 | A * | 6/1981 | Klein | B66B 7/048 187/409 |
| 4,598,798 | A * | 7/1986 | Koppensteiner | B66B 7/048 187/409 |

(Continued)

FOREIGN PATENT DOCUMENTS

| | | | |
|---|---|---|---|
| JP | H09221291 | A | 8/1997 |
| JP | 2004250127 | A | 9/2004 |
| WO | WO-2011070237 | A1 | 6/2011 |

OTHER PUBLICATIONS

European Search Report for EPSN 13 18 4472 dated Feb. 24, 2014.

*Primary Examiner* — Michael Riegelman

(74) *Attorney, Agent, or Firm* — Harness, Dickey & Pierce, P.L.C.

(57) ABSTRACT

Gliding means are attached to a side frame of the car sling, said gliding means comprising a gliding part supported through elasticity means on a frame part. The side frame is positioned on a guide rail in an elevator shaft so that the gliding part of the gliding means sets on the guide rail. The gliding means is provided with an installation jig comprising a first branch positioned between the gliding part and the guide rail, and a second branch positioned in an open space between the frame part and the gliding part for bypassing the elasticity means. The installation jig is removed when the installation of the car sling and the car has been completed.

9 Claims, 3 Drawing Sheets

(56) References Cited

U.S. PATENT DOCUMENTS

| | | | | | |
|---|---|---|---|---|---|
| 4,652,146 | A * | 3/1987 | Ellermann | F16C 29/02 | 187/409 |
| 4,716,991 | A * | 1/1988 | Riechers | B66B 7/047 | 187/406 |
| 6,131,704 | A * | 10/2000 | Viita-Aho | B66B 7/047 | 188/165 |
| 2010/0065382 | A1 | 3/2010 | Beaudry | | |
| 2013/0098714 | A1* | 4/2013 | Kocher | B66B 7/047 | 187/409 |
| 2015/0217972 | A1* | 8/2015 | Hawkins | G01C 15/10 | 187/391 |
| 2015/0239710 | A1* | 8/2015 | Det | B66B 7/047 | 187/409 |

* cited by examiner

METHOD FOR INSTALLING AN ELEVATOR CAR SLING

This application claims priority to European Patent Application No. EP13184472 filed on Sep. 16, 2013, the entire contents of which are incorporated herein by reference.

FIELD OF THE INVENTION

The invention relates to a method for installing an elevator car sling according to the preamble of claim 1.

The invention also relates to an installation jig intended to be used in the installation method.

BACKGROUND ART

An elevator comprises an elevator car moving in a first direction upwards and downwards in an elevator shaft. The elevator car transports people and/or goods between the landings in a building. The elevator car is supported by a car sling comprising a horizontal upper transom, a horizontal lower transom and vertical side frames connecting the ends of the upper transom and the lower transom. There are further guide rails being attached to the wall structure of the elevator shaft and extending vertically along the height of the elevator shaft. The car sling is guided with gliding means on the guide rails. The car is thus guided in the lateral direction with the gliding means gliding on the guide rails when moving up and down in the elevator shaft.

The horizontal cross-section of the guide rails has the form of a letter T. The horizontal branch of the letter T is attached to support means being attached to the wall structure of the elevator shaft. The vertical branch of the letter T forms three gliding surfaces for the gliding means. There are thus two opposite side gliding surfaces and one front gliding surface in the guide rail. The gliding means comprises a frame part and a gliding part. The horizontal cross-section of the gliding part has the form of a letter U so that the inner surface of the gliding part sets against the three gliding surfaces of the guide rail. The horizontal cross section of the frame part has also a U-shaped section surrounding the gliding part on three sides. The frame part comprises further outwardly extending flanges at the bottom of the letter U for attaching the gliding means to the vertical side frame of the car sling. There are elasticity means between the gliding part and the frame part in order to isolate the gliding part from the frame part.

The guide rails are formed of rail elements of a certain length. The rail elements are connected in the installation phase end-on-end one after the other. It is almost impossible to install the guide rails so that they would form a fully straight line along the whole height of the elevator shaft. The inevitable small deviations in the straightness of the guide rail will result in lateral forces acting on the gliding means when the car moves upwards and downwards in the shaft. These lateral forces will cause vibrations acting on the gliding means and thereby also acting on the car. The vibrations acting on the car will also cause noise disturbing the passengers in the car. The elasticity means between the gliding part and the frame part in the gliding means absorb the vibrations and prevent the vibrations from progressing to the car.

WO 2011/070237 discloses gliding means of an elevator. The gliding means comprises a frame part, a gliding part and an elastic insulation part between the frame part and the gliding part. The elastic insulation part insulates the elevator car from the guide rail.

US 2010/0065382 discloses gliding means comprising a gliding part for an elevator. The gliding means comprises further a first bracket connected to the gliding part and a second bracket connected to the car. There are further a plurality of elongated elastomeric members arranged generally from a first end of the gliding means to a second end of the gliding means and connected between the first bracket and the second bracket. The gliding part and the first bracket are substantially surrounded on three sides by the second bracket. Each of the plurality of elongated elastomeric members is configured for deflection under loads of increasing magnitude.

The flexible support achieved with the elasticity means between the gliding part and the frame part of the gliding means is, however, problematic during the installation of the car sling. The gliding means is attached to the upper portion and the lower portion of the side frame of the car sling. The side frames are then positioned against the guide rail so that the gliding part of the gliding means sets against the guide rail. The side frames of the car sling are kept in place during the installation of the lower transom, the car and the upper transom by compression with a G-clamp positioned at the lower end of the side frames. The compression of the G-clamp will result in that the lower gliding means is pressed toward the guide rail due to the elasticity means between the glide part and the frame part. This will result in that the side frame will become inclined.

There are also prior art flexible gliding means containing screws at the back of the gliding means for restraining the rubber isolation between the gliding part and the frame part during installation of the car sling. The screws in these prior art gliding means need to be adjusted after the installation of the car sling in order to retain the flexibility of the rubber isolation. The screws help to keep the vertical side frames of the car sling in a vertical position during installation of the frame. The screws do not, however, eliminate the need to adjust the recommended 0.5 to 1 mm gap between the gliding surface of the gliding means and the guide rail after the car sling and the car has been installed.

BRIEF DESCRIPTION OF THE INVENTION

An object of the present invention is to solve the problems associated with prior art methods for installing an elevator car sling.

The method for installing an elevator car sling according to the invention is characterized by what is stated in the characterizing portion of claim 1.

The method for installing an elevator car sling comprises the steps of:

attaching gliding means to a side frame of the car sling, said gliding means comprising at least a frame part, a gliding part, and elasticity means through which the gliding part is supported on the frame part, positioning the side frame on a guide rail in an elevator shaft so that the gliding part of the gliding means sets on the guide rail.

The method is characterized by the further steps of:

providing the gliding means with an installation jig comprising a first branch that is positioned against an inner gliding surface of the gliding part thereby forming a temporary gliding surface towards the guide rail and at least a second branch that is positioned in an open space between the frame part and the gliding part in order to temporary bypass the elasticity means and rigidly fix the gliding part to the frame part, removing the installation jig when the installation of the car sling and the car has been completed.

The installation jig intended to be used in the method comprises at least two branches.

The use of installation jigs makes it possible to install the side frame of the car sling with the gliding means exactly in a vertical position and exactly at a desired distance from the guide rail right away.

The installation jigs are pushed into the gliding means and the gliding means are attached to the vertical side frames of the car sling before the installation of the car sling and the car in the elevator shaft. These pre-installations cane be done already at the factory before the material is transported to the installation site.

The vertical side frames of the car sling comprising the gliding means with inserted installation jigs are thus positioned against the guide rails in the elevator shaft at the beginning of the installation. The vertical side frames are then fastened temporary to the guide rails e.g. with cable ties or G-clamps. The lower transom is then fastened between the vertical side frames. The car is then erected on the lower transom and finally the upper transom is fastened between the vertical side frames. Then finally the installation jigs are removed from the gliding means. The installation jigs can be removed by simply pulling by hand.

The installation jigs remove the need to position the gliding means after the installation of the car sling and the car has been completed. The installation jig comprises at least a first branch that fits into a bottom of the gliding part. The first branch of the installation jig will thus be positioned between the inner surface of the gliding part of the gliding means and the front surface of the guiding rail. The first branch of the installation jig eliminates the need to adjust the distance of the inner surface of the gliding part to the front surface of the guide rail after the installation of the car sling and the car has been completed. The first branch of the installation jig leaves a gap corresponding to the thickness of the first branch of the installation jig between the inner surface of the gliding part and the front surface of the guide rail when the installation jig is removed. The thickness of the first branch is advantageously 1.0 mm. The first branch fills the gap between the bottom of the gliding part and the front surface of the guide rail temporary during the installation. Concrete dust cannot thus penetrate into the glide surface of the gliding part of the gliding means during the installation. This will reduce wear of the gliding surface of the gliding part of the gliding means.

The installation jig comprises further at least a second branch that fits into an open space between the frame part and the gliding part of the gliding means. The second branch bypasses the elasticity means temporary and fixes the gliding part rigidly to the frame part. The temporary elimination of the elasticity between the gliding part and the frame part of the gliding means with the installation jig results in that the vertical side frames and the gliding means are in the right position in relation to the guide rail from the very beginning of the installation.

The use of the installation jig will eliminate the need to adjust the gliding means after the installation of the car sling and the car has been completed. This will reduce the total installation time of the car sling and the car. The installation jigs can simply be pulled out by hand from the gliding means after the installation of the car sling and the car has been completed. The elasticity between the gliding part and the frame part of the gliding means is thus restored when the installation jig is removed.

BRIEF DESCRIPTION OF THE DRAWINGS

The invention will in the following be described in greater detail by means of preferred embodiments with reference to the attached drawings, in which.

DETAILED DESCRIPTION OF EMBODIMENTS OF THE INVENTION

Figure 1:
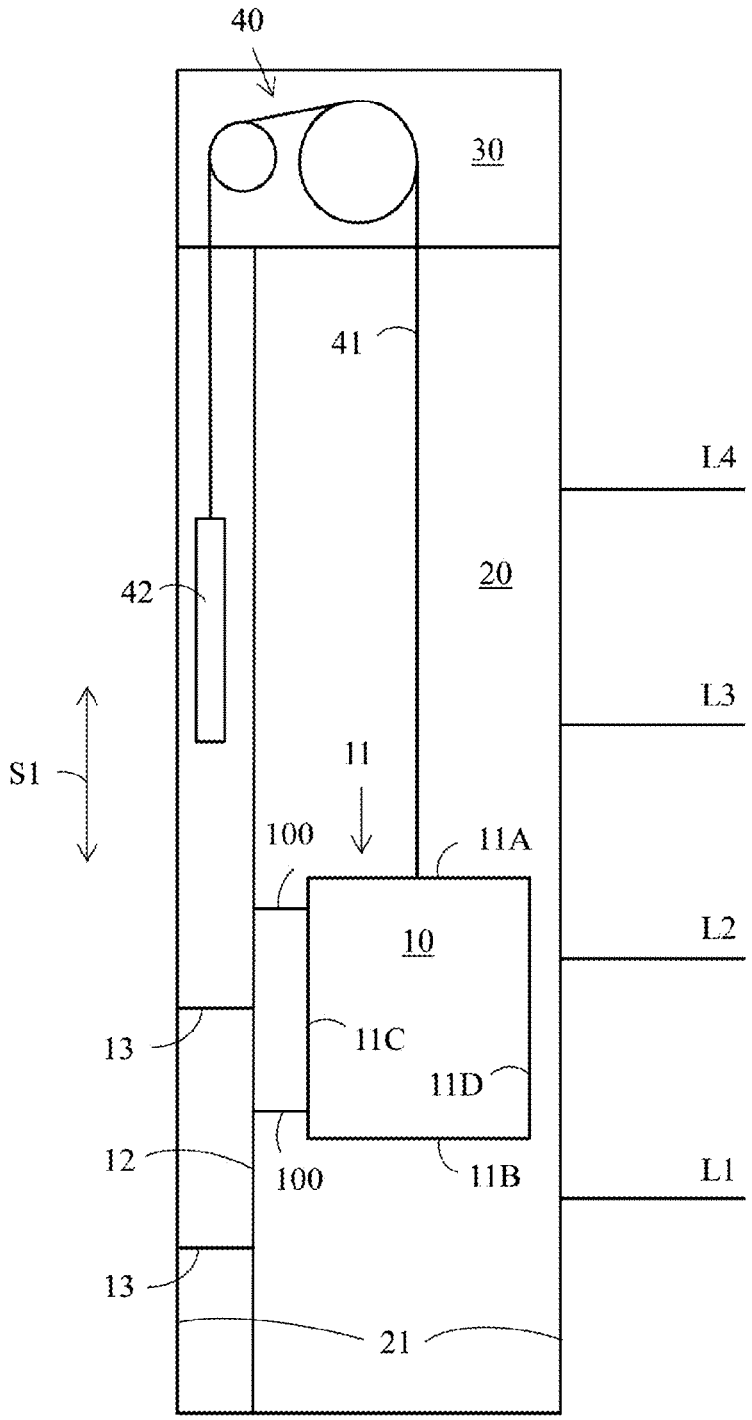
FIG. 1 shows a vertical cross section of an elevator.

FIG. 1 shows a vertical cross section of an elevator. The elevator comprises a car 10 supported by a car sling 11, an elevator shaft 20, a machine room 30, lifting machinery 40, ropes 41, and a counter weight 42. The car sling 11 is a support construction comprising a horizontal upper transom 11A, a horizontal lower transom 11B, a first vertical side frame 11C and a second vertical side frame 11D. The vertical side frames 11C, 11D connect the ends of the upper transom 11A and the lower transom 11B. The lifting machinery 40 moves the car 10 in a first direction S1 upwards and downwards in the vertically extending elevator shaft 20. The car 10 is carried through the car sling 11 by the ropes 41, which connect the upper transom 11A of the car sling 11 to the counter weight 42. The car sling 11 is further supported through the vertical side frames 11C, 11D with gliding means 100 at guide rails 12 extending in the vertical direction in the shaft 20. The figure shows only one guide rail 12, but there are normally two guide rails 12 at opposite sides of the car 10. The gliding means 100 can comprise rolls rolling on the guide rails 12 or gliding shoes gliding on the guide rails 12 when the car 10 is mowing upwards and downwards in the elevator shaft 20. The guide rails 12 are supported with support means 13 at the side wall structures 21 of the elevator shaft 20. The figure shows only two support means 13, but there are several support means 13 along the height of the guide rail 12. The gliding means 100 engaging with the guide rails 12 keep the car 10 in position in the horizontal plane when the car 10 moves upwards and downwards in the elevator shaft 20. The counter weight 42 is supported in a corresponding way on guide rails supported on the wall structure 21 of the shaft 20. The car 10 transports people and/or goods between the landings L1 to L4 in the building. The elevator shaft 20 can be formed so that the wall structure 21 is formed of solid walls or so that the wall structure 21 is formed of an open steel structure.

The guide rails 12 extend vertically along the height of the shaft 20. The guide rails 12 are thus formed of rail elements of a certain length. The rail elements are connected in the installation phase end-on-end one after the other. It is almost impossible to install the guide rails 12 so that they would form a fully straight line along the whole height of the shaft 20. The inevitable small deviations in the straightness of the guide rail 12 will result in lateral forces acting on the gliding means 100 when the car 10 moves upwards and downwards in the shaft 20. These lateral forces will cause vibrations to the gliding means 100 and thereby also to the car 10. The vibrations acting on the car 10 will also cause noise disturbing the passengers in the car 10. The gliding means 100 are therefore provided with elasticity means, which absorb the vibrations and prevent the vibrations from progressing to the car 10.

Figure 2:
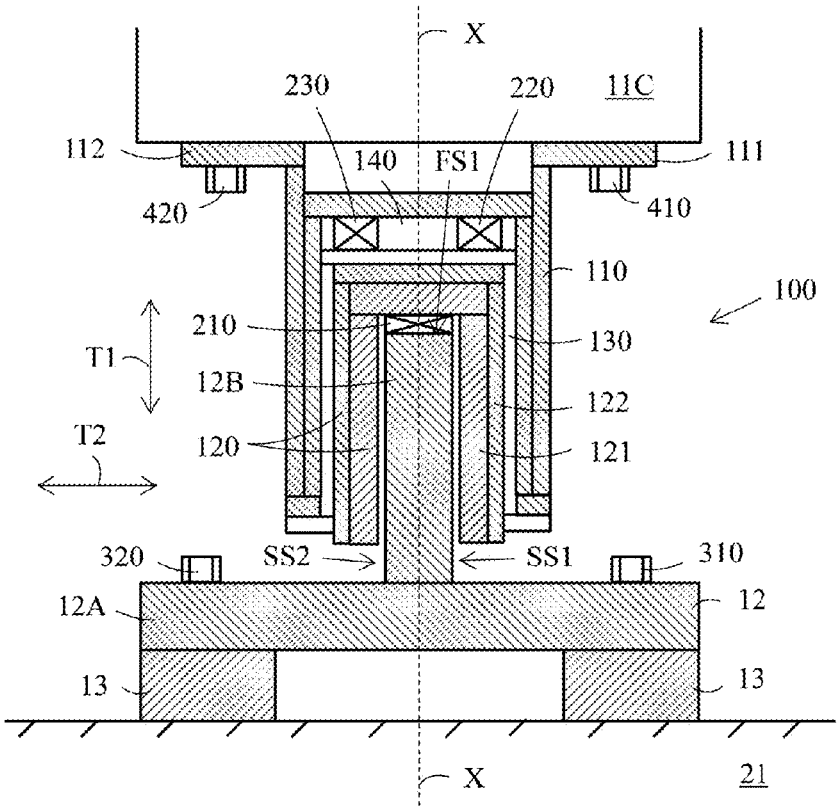
FIG. 2 shows a horizontal cross section of the support of the car sling at the guide rail.

FIG. 2 shows a cross section of the support of the car sling at the guide rail. Each side frame 11C, 11D of the car sling 11 is supported with gliding means 100 on the guide rail 12. The horizontal cross-section of the guide rail 12 has the form of a letter T. The horizontal branch 12A of the T-shaped guide rail 12 is attached with bolts 310, 320 to support means 13 that are attached to the wall 21 of the shaft 20. Each gliding means 100 comprises a frame part 110, a gliding part 120 and elasticity means 130 between the frame part 110 and the gliding part 120.

The frame part 110 has an essentially U-shaped horizontal cross section with two outwardly extending flanges 111, 112 at the bottom portion of the letter U. The frame part 110 is advantageously manufactured from a metal piece by bending so that the two branches of the letter U have a double thickness. The frame part 110 is attached to the vertical side frame 11C of the car sling 11 with bolts 410, 420 passing through the flanges 111, 112 of the frame part 110.

The gliding part 120 has an essentially U-shaped horizontal cross section. The gliding part 120 comprises a U-shaped gliding section 121 made of plastic positioned within a U-shaped support section 122 made of metal. The U-shaped gliding section 121 and the U-shaped support section 122 open in the same direction. The ends of the side portions of the support section 122 are bent 90 degrees inwards in order to form flanges. These flanges extend partly over the ends of the side portions of the gliding section 121 in order to keep the gliding section 121 in position within the support section 122. The inner surface of the gliding section 121 glides on the vertical branch 12B of the T-shaped guide rail 12. The gliding section 121 is thus gliding on the two opposite side surfaces SS1, SS2 and on the front surface FS1 of the vertical branch 12B of the guide rail 12.

The elasticity means 130 is positioned between the frame part 110 and the gliding part 120. The elasticity means 130 surrounds the outer surface of the support section 122 in the gliding part 120. The elasticity means 130 forms thus a U-shaped loop. The ends of the loop are attached to the outer end portions of the two branches of the U-shaped frame part 110. The gliding part 120 is thus attached to the frame part 110 only through the elasticity means 130. There is a space 140 between the bottom of the U-shaped elasticity means 130 and the bottom of the U-shaped frame part 110. The elasticity means 130 can thus be stretched to some degree so that the gliding part 120 can move a certain distance in a second lateral direction T1 in the space 140 between the bottom of the U-shaped elasticity means 130 and the bottom of the U-shaped frame part 110. The gliding part 120 is thus flexibly supported on the frame part 110 through the elasticity means 130. The second direction T1 is the direction formed by a longitudinal centre axis X-X of the vertical branch 12B of the T-shaped guide rail 12. The gliding part 120 is also flexibly supported in a third direction T2 being perpendicular to the second direction T1. The flexibility in this third direction T2 is due to the elasticity means 130, which can be compressed between the gliding part 120 and the frame part 110 on either side of the gliding part 120 when the gliding part 120 oscillates in the third direction T2. The forces acting on the gliding means 100 in the third direction T2 are more ample than the forces acting in the second direction T1. This is due to the mechanical construction of the elevator. This means that the gliding means 100 has to be more rigid in this third direction T2 compared to the second direction T1. The amount of flexibility is also limited by the safety gear, which allows a greater flexibility in the second direction T1 compared to the third direction T2. This described arrangement utilizes the maximum possible flexibility in both directions i.e. in the second direction T1 and in the third direction T2.

Figure 3:
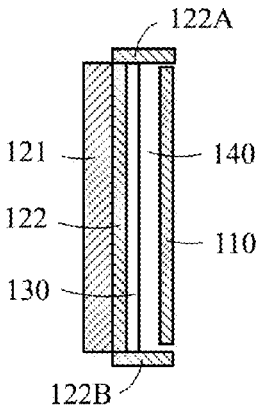
FIG. 3 shows a vertical cross section of the gliding means.
Figure 4:
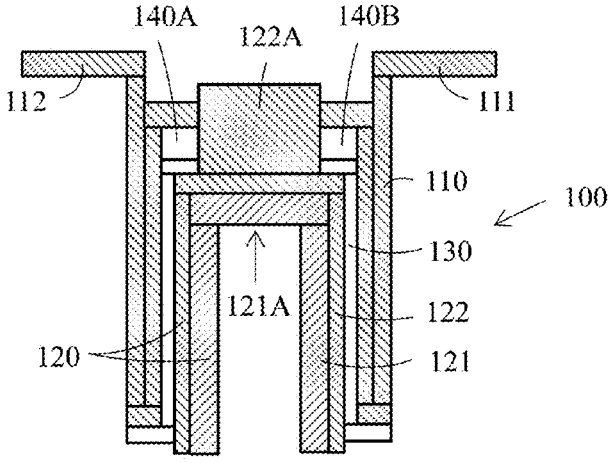
FIG. 4 shows a horizontal cross section of the gliding means.

FIG. 3 shows a vertical cross section of the gliding means and FIG. 4 shows a horizontal cross section of the gliding means. The ends of the bottom portion of the support section 122 of the gliding part 120 are bent 90 degrees outwards in order to form flanges 122A, 122B. These flanges 122A, 122B extend over the elasticity means 130 and the ends of the bottom portion of the frame part 110. The flanges 122A, 122B can thus glide on the ends of the bottom portion of the frame part 110 in order to keep the gliding part 120 in position within the frame part 110 when the bottom of the gliding part 120 is moving closer to or longer from the bottom of the frame part 110 in the open space 140. The flanges 122A, 122B close a middle portion of the open space 140 between the bottom of the gliding part 120 and the bottom of the frame part 110. The end portions 140A, 140B of the open space 140 still remain open. The second branch 220 and the third branch 230 of the installation jig 200 can penetrate into these open spaces 140A, 140B when the installation jig 200 is inserted into the gliding means 100. The first branch 210 of the installation jig 200 penetrates into the bottom portion 121A of the gliding section 121 of the gliding part 120 of the gliding means 100. The first branch 210 of the installation jig 200 sets against the inner surface i.e. the gliding surface of the bottom portion 121A of the gliding part 120.

Figure 5:
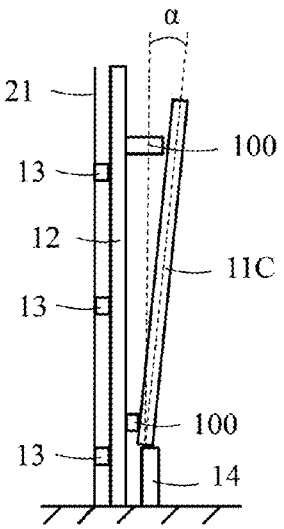
FIG. 5 shows the installation of the vertical side frame of the car sling to the guide rail.

FIG. 5 shows the installation of the vertical side frame of the car sling to the guide rail. A gliding means 100 is attached to each end of the vertical side frame 11C, 11D of the car sling 11. The package comprising the side frame 11C, 11D and the gliding means 100 is then positioned on the T-shaped guide rail 12 so that the gliding part 120 of the gliding means 100 sets on the three surfaces of the vertical branch 12B of the T-shaped guide rail 12. The flexible support achieved with the elasticity means 130 between the gliding part 120 and the frame part 110 is, however, problematic during the installation of the side frame 11C, 11D of the car sling 11. The side frames 11C, 11D have to be kept in place during the installation of the lower transom 11B, the car 10 and the upper transom 11A. This can be done e.g. by using a G-clamp positioned at the lower end of the side frames 11C, 11D. The compression of the G-clamp will result in that the elasticity means 130 in the lower gliding means 100 becomes tensioned i.e. the frame part 110 moves towards the gliding part 120. This will result in that the side frame 11C, 11D will be inclined by an angle $\alpha$. The gliding surface of the gliding part 120 of the gliding means 100 will seat against the front surface FS1 of the guide rail 12. There will thus be a need to adjust the position of the gliding means 100 after the sling 11 and the car 10 has been completed. This is done by shim plates positioned between the flanges 111, 112 of the frame part 110 and the side frames 11C, 11D of the sling 11. The shim plates can have a thickness in the range of 0.5 mm to 1.0 mm. The gliding means 100 are positioned with the shim plates so that there remains a 0.5 mm to 1.0 mm gap between the front surface FS1 of the guide rail 12 and the bottom surface of the gliding section 121 of the gliding part 120 of the gliding means 100. The positioning of the gliding means 100 is a time consuming extra step in the installation.

Figure 6:
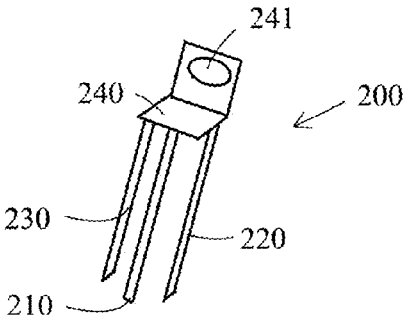
FIG. 6 shows the installation jig used to stiffen the gliding shoe.

FIG. 6 shows the installation jig used to stiffen the gliding means. The installation jig 200 comprises a first branch 210, a second branch 220, and a third branch 230 attached to a support structure 240. The jig is used during the installation of the car sling 11 in order to temporary bypass the elasticity means 130. The gliding part 120 becomes rigidly supported on the frame part 110 when the installation jig 200 is inserted between the gliding part 120 and the frame part 110. FIG. 3 shows the position of the branches 210, 220, 230 of the jig 200 when the installation jig 200 is inserted into the gliding means 100. The first branch 210 of the installation jig 200 is positioned between the front surface FS1 of the guide rail 12 and the bottom inner surface of the gliding section 121 of the gliding part 120 of the gliding means 100. The second branch 220 and the third branch 230 of the installation jig 200 are positioned in the respective open space 140 between the bottom portion of the elasticity means 130 and the bottom portion of the frame part 110 of the gliding means 100. The second branch 220 and the third branch 230 will thus eliminate the movement of the gliding part 120 within the frame part 110 in the second direction T1. The second branch 220 and the third branch 230 of the installation jig 200 will temporarily fix the gliding part 120 to the frame part 110. The second branch 220 and the third branch 230 will thus bypass the elasticity means 130. The second branch 220 and the third branch 230 will also to some extent compress the elasticity means 130 against the outer surface of the bottom of the gliding part 120. The thickness of the second branch 220 and the third branch 230 of the installation jig 200 is adapted to the thickness of the open space 140 between the bottom portion of the sliding part 120 and the bottom portion of the frame part 110. The first branch 210 of the installation jig 200 will on the other hand keep the inner surface of the gliding section 121 of the gliding part 120 at a certain distance from the front surface FS1 of the guide rail 12. This distance is determined by the thickness of the first branch 210, which thickness is advantageously 1.0 mm.

The installation jigs 200 are pushed into the gliding means 100 and the gliding means 100 are attached to the vertical side frames 11C, 11D of the sling 11 before the installation of the car sling 11 and the car 10 in the elevator shaft 20. The vertical side frames 11C, 11D of the car sling 11 comprising the gliding means 100 with inserted installation jigs 200 are thus positioned against the guide rails 12 in the shaft 20 at the beginning of the installation. The vertical side frames 11C, 11D are then fastened temporary to the guide rails 12 e.g. with cable ties or G-clamps. The lower transom 11B is then fastened between the vertical side frames 11C, 11D. The car 10 is then erected on the lower transom 11B and finally the upper transom 11A is fastened between the vertical side frames 11C, 11D. Then finally the installation jigs 200 are removed from the gliding means 100. The installation jigs 200 can be removed by simply pulling by hand from the opening 241 in the support part 240. There is thus no need to position the gliding means 100 in relation to the guide rail 12 after the installation of the car sling 11 and the car 10 has been completed. The second branch 220 and the third branch 230 of the installation jig 200 eliminate the elasticity between the gliding part 120 and the frame part 110 of the gliding means 100 and thereby make sure that the vertical side frames 11C, 11D and the gliding means 100 are in the right position in relation to the guide rail 12 from the very beginning of the installation. The first branch 210 of the installation jig 200 makes sure that there remains a 1.0 mm gap between the bottom surface of the gliding section 121 of the gliding part 120 and the front surface FS1 of the guide rail 12 when the installation jig 200 is removed.

The use of the invention is naturally not limited to the type of elevator disclosed in FIG. 1, but the invention can be used in any type of elevator e.g. also in elevators lacking a machine room and/or a counterweight.

The use of the invention is also not limited to the type of gliding means 100 shown in the figures. The gliding means 100 can be of any kind as long as there is a gap between the gliding part 120 and the frame part 110 of the gliding means 100 into which gap at least one branch of the installation jig 200 can be pushed in order to temporary eliminate the elasticity between the gliding part 120 and the frame part 110. The installation jig 200 bypasses the elasticity means 130.

The invention could be used e.g. in connection with the gliding means disclosed in US 2010/0065382. The elasticity means comprises in this solution of three different elasticity means. A first elasticity means is positioned between the bottom portion of the U-shaped frame part and the bottom portion of the U-shaped gliding part. A second elasticity means is positioned between a first branch of the U-shaped frame part and the U-shaped gliding part. A third elasticity means is positioned between a second branch of the U-shaped frame part and the U-shaped gliding part. The second 220 and the third 230 branch of the installation jig 200 could thus be positioned in an open space on both sides of the first elasticity means between the bottom portion of the gliding part and the bottom portion of the frame part. The second 220 and the third 230 branch of the installation jig 200 would thus be in direct contact with the outer surface of the bottom portion of the gliding part and the inner surface of the bottom portion of the frame part. The first branch 210 of the installation jig 200 would be positioned in the same place as in the gliding means shown in FIG. 3 i.e. against the inner surface of the bottom portion of the gliding part.

The second branch 220 and the third branch 230 of the installation jig 200 could thus be positioned in the open space between the bottom portion of the gliding part and the bottom portion of the frame part so that they are in direct contact with the outer surface of the bottom portion of the gliding part and the inner surface of the bottom portion of the frame part or so that they are indirectly through the elasticity means in contact with the bottom portion of the gliding part and in direct contact with the inner surface of the bottom portion of the frame part.

The use of the invention is also not limited to the type of guide rail 12 shown in the figures. The guide rail 12 could be of any type as long as a flexible gliding means 100 can be used in connection with the guide rail 12.

The invention is also not limited to the kind of installation jig 200 shown in the figures. The installation jog 200 in the figures comprises three branches 210, 220, 230, which is suitable for the gliding means 100 shown in the figures. The first branch 210 of the installation jig 200 is needed in order to adjust the distance between front surface FS1 of the guide rail 12 and the bottom of the gliding part 12. The second branch 220 and the third branch 230 are adapted to the gliding means 100 shown in the figures i.e. to a gliding means 100 having two open spaces 140 between the gliding part 120 and the frame part 110 into which open spaces 140 the second branch 220 and the third branch 230 can be inserted. The installation jig 200 could, however, in addition to the first branch 210 comprise only one second branch or more than two second branches.

It will be obvious to a person skilled in the art that, as the technology advances, the inventive concept can be implemented in various ways. The invention and its embodiments are not limited to the examples described above but may vary within the scope of the claims.

The invention claimed is:

1. A method for installing an elevator car sling associated with an elevator car, the method comprising:

inserting an installation jig in a gliding device, the gliding device including at least a frame, a gliding part, and an elasticity device, the elasticity device configured to support the gliding part on the frame, the installation jig including a first branch and at least one second branch, the first branch being positioned against an inner gliding surface of the gliding part to form a temporary gliding surface to glide on a guide rail, the at least one second branch being positioned in an open space between the frame and the gliding part to rigidly fix the gliding part to the frame such that the installation jig temporary bypasses the elasticity device;

attaching the gliding device to a side frame of the elevator car sling;

positioning the side frame having the gliding device attached thereto on the guide rail in an elevator shaft so that the gliding part of the gliding device is connected to the guide rail to install the elevator car sling; and removing the installation jig after the elevator car is installed in the elevator car sling to install the elevator car sling.

2. The method according to claim 1, wherein a horizontal cross section of the guide rail is T-shaped such that a vertical branch of the T-shaped guide rail forms a gliding surface for the gliding device.

3. The method according to claim 2, wherein a horizontal cross section of the gliding part of the gliding device is U-shaped such that an inner surface of the U-shaped gliding device is connected to the gliding surface of the guide rail.

4. The method according to claim 3, wherein a horizontal cross section of the frame of the gliding device is U-shaped such that the gliding part is inside the frame so that the frame and the gliding part open in a same direction.

5. The method according to claim 4, wherein the elasticity device is on an outer surface of the gliding part such that elasticity device forms a U-shaped loop, the U-shaped loop having ends that are attached to outer end portions of two branches of the U-shaped frame such that the gliding part is attached to the frame only through the elasticity device.

6. The method according to claim 5, wherein the installation jig includes the first branch and two second branches, the first branch being configured to fit into a bottom portion of the gliding part and the two second branches being configured to fit into a respective open space between a bottom portion of the frame and a bottom portion of the gliding part of the gliding device.

7. The method of claim 1, further comprising:

fastening a lower transom associated with the elevator car sling to the side frame.

8. The method of claim 7, further comprising:

installing the elevator car in the elevator car sling; and fastening an upper transom associated with the elevator car sling to the side frame.

9. An elevator comprising:

a gliding device in a first position while installing an elevator car sling, the gliding device including at least a gliding part configured to glide on a guide rail, a frame and an elasticity device configured to apply an elastic force against a side frame of the elevator car sling when the gliding device is compressed towards a second position; and an installation jig configured to, hold the gliding device in the first position while installing the elevator car sling, the installation jig including a first branch and at least one second branch, the first branch being positioned against an inner gliding surface of the gliding part to form a temporary gliding surface to glide on the glide rail, the at least one second branch being positioned in an open space between the frame and the gliding part to hold the gliding device in the first position such that the installation jig temporary bypasses the elasticity device, and detach from the gliding device after the elevator car is installed in the elevator car sling to allow the gliding device to compress toward the second position.

* * * * *